US012054863B2

(12) United States Patent
Park et al.

(10) Patent No.: US 12,054,863 B2
(45) Date of Patent: Aug. 6, 2024

(54) METHOD FOR PRODUCING POLYESTER NONWOVEN FABRIC WITH IMPROVED IMPREGNATION PROPERTY OF FABRIC SOFTENER

(71) Applicant: KOLON INDUSTRIES, INC., Seoul (KR)

(72) Inventors: Young-shin Park, Seoul (KR); Min-ho Lee, Seoul (KR); Hee-jung Cho, Seoul (KR); Woo-seok Choi, Seoul (KR); Jung-soon Jang, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 1007 days.

(21) Appl. No.: 16/971,141

(22) PCT Filed: Mar. 19, 2019

(86) PCT No.: PCT/KR2019/003156
§ 371 (c)(1),
(2) Date: Aug. 19, 2020

(87) PCT Pub. No.: WO2019/190109
PCT Pub. Date: Oct. 3, 2019

(65) Prior Publication Data

US 2021/0102322 A1 Apr. 8, 2021

(30) Foreign Application Priority Data

Mar. 28, 2018 (KR) ..... 10-2018-0035891

(51) Int. Cl.

| | |
|---|---|
| ***D04H 3/11*** | (2012.01) |
| ***D04H 3/011*** | (2012.01) |
| ***D04H 3/016*** | (2012.01) |
| ***D06C 15/00*** | (2006.01) |

(52) U.S. Cl.
CPC ..... *D04H 3/011* (2013.01); *D04H 3/016* (2013.01); *D06C 15/00* (2013.01)

(58) Field of Classification Search
CPC ..... D04H 3/011; D04H 3/016; D04H 3/153; D06C 15/00
USPC ..... 442/327, 401
See application file for complete search history.

(56) References Cited

U.S. PATENT DOCUMENTS

| | | | | |
|---|---|---|---|---|
| 5,929,026 | A * | 7/1999 | Childs | C11D 17/047 510/491 |
| 7,838,449 | B2 | 11/2010 | Black et al. | |
| 7,994,081 | B2 | 8/2011 | Farell et al. | |
| 2004/0092192 | A1 | 5/2004 | Willis | |
| 2005/0014673 | A1 * | 1/2005 | Kwitkowski | D04H 3/14 510/515 |
| 2014/0154943 | A1 | 6/2014 | Choi et al. | |

FOREIGN PATENT DOCUMENTS

| | | | |
|---|---|---|---|
| EP | 3663452 | A2 | 9/2018 |
| KR | 10-2004-0105931 | A | 12/2004 |
| KR | 1020050047793 | A | 5/2005 |
| KR | 100823112 | B1 * | 4/2008 |
| KR | 100823112 | B1 * | 6/2010 |
| KR | 10-2013-0035414 | A | 4/2013 |
| KR | 10-2014-0034538 | A | 3/2014 |
| KR | 10-2014-0042379 | A | 4/2014 |
| KR | 10-2015-0011129 | A | 1/2015 |
| KR | 10-2015-0074374 | A | 7/2015 |
| WO | 2013048077 | A1 | 4/2013 |

OTHER PUBLICATIONS

International Search Report for PCT/KR2019/003156 dated Jun. 18, 2019 (PCT/ISA/210).
European Search Report dated Aug. 26, 2021.

* cited by examiner

*Primary Examiner* — Matthew D Matzek
(74) *Attorney, Agent, or Firm* — Harvest IP Law, LLP

(57) ABSTRACT

The present disclosure relates to a method for producing a nonwoven fabric which improves the impregnation property of a fabric softener in the nonwoven fabric so as to apply the nonwoven fabric to a dryer sheet (sheet-type fabric softener). In a nonwoven fabric made of two types of polyester long fiber mixed filament yarns, by widening the specific surface area, adjusting the evenness deviation to be small and increasing the porosity, the impregnation property of a fabric softener is improved even when the nonwoven fabric is made lightweight, and the nonwoven fabric can be applied to a dryer sheet.

5 Claims, No Drawings

METHOD FOR PRODUCING POLYESTER NONWOVEN FABRIC WITH IMPROVED IMPREGNATION PROPERTY OF FABRIC SOFTENER

CROSS REFERENCE TO RELATED APPLICATIONS

This application is a National Stage of International Application No. PCT/KR2019/003156 filed Mar. 19, 2019, claiming priority based on Korean Patent Application No. 10-2018-0035891 filed Mar. 28, 2018.

TECHNICAL FIELD

The present disclosure relates to a method for producing a nonwoven fabric which improves the impregnation property of a fabric softener in the nonwoven fabric so as to apply the nonwoven fabric to a dryer sheet (sheet-type fabric softener).

BACKGROUND ART

Dryer sheet is a sheet-type fabric softener, which imparts flexibility, antistatic properties, and fragrance properties to laundry.

In general, the fabric softener for a dryer sheet has characteristics that it is liquefied by heating and then coated onto a nonwoven web through a gravure roll to be solidified at room temperature. Thereby, in the process of producing the dryer sheet, the evenness or uniformity of nonwoven fabric, wear resistance, and impregnation amount of the fabric softener are important factors.

For the first-generation dryer sheet, a cellulose-based nonwoven fabric web was utilized in consideration of heat resistance and abrasion resistance, and this dryer sheet is produced through wet-laid techniques and has dense structures. However, this has a disadvantage in that impregnation and delamination properties of the fabric softener are reduced.

For the second-generation dryer sheet, a polyester-based short-fiber nonwoven fabric web was utilized to improve the impregnation and delamination properties of the fabric softener. However, there are problems that the producing process is complicated, the productivity is low, the production of a low-weight nonwoven fabric is made difficult, and the wear resistance of the nonwoven fabric is reduced.

For the third-generation dryer sheet, a long-fiber nonwoven fabric web was applied to complement the productivity and wear resistance of the polyester short-fiber nonwoven fabric web. However, there is a disadvantage in that laundry is contaminated due to fuzz (or fussy)-generation due to yarn breakage in the nonwoven fabric web, and therefore, various techniques have been developed, such as a technique for suppressing fuzz-generation, as disclosed in Korean Unexamined Patent Publication No. 2004-0105931 entitled "Long-fiber nonwoven fabric for dryer sheet and a method for producing the same".

Meanwhile, everyday consumer goods makers attempt to continuously reduce production costs in order to increase the demand for products in the market.

Consequently, even in the dryer sheet, the weight of the nonwoven fabric tends to be reduced from 30 gsm level to 20 gsm or less. However, the reduction of specific surface area and the increase of density deviation due to the reduction of the weight of the nonwoven fabric leads to a problem that the impregnation property of the fabric softener is deteriorated.

DETAILED DESCRIPTION OF THE INVENTION

Technical Problem

The present disclosure has been devised to solve the above-mentioned problems, and an object thereof is to provide a method for producing a nonwoven fabric exhibiting excellent impregnation properties of a fabric softener even when the nonwoven fabric is made lightweight.

Technical Solution

In order to achieve the above object, there is provided a nonwoven fabric with improved impregnation property of a fabric softener characterized in that it is a long-fiber mixed nonwoven fabric comprising: 70 to 90% by weight of a first polyester filament having a melting point of 250° C. or higher and 10 to 30% by weight of a second polyester filament having a melting point of 235° C. or lower, wherein the first filament and the second filament has a fineness of 3 to 10 denier, and the nonwoven fabric has a specific surface area of 0.090 to 0.180 $m^2/g$, and an evenness deviation of 260 or less.

There is also provided a method for producing a nonwoven fabric with improved impregnation property of a fabric softener, the method comprising the steps of: mixed-spinning 70 to 90% by weight of a first polyester filament having a melting point of 250° C. or higher and 10 to 30% by weight of a second polyester filament having a melting point of 235° C. or lower, and drawing the spun filaments at a drawing speed of 4,500 to 5,500 m/min to produce mixed filament yarns so that the fineness of the first filament and the second filament is 3 to 10 denier; laminating the mixed filament yarns to form a web; and adjusting the thickness in the calendering process of passing the web through a calender roller to produce a nonwoven fabric having a specific surface area of 0.090 to 0.180 $m^2/g$ and an evenness deviation of 260 or less.

Advantageous Effects

According to the present disclosure, in a nonwoven fabric made of two types of polyester long-fiber mixed filament yarns, by widening the specific surface area, adjusting the evenness deviation to be small and increasing the porosity, the impregnation property of a fabric softener is improved even when the nonwoven fabric is made lightweight, and the nonwoven fabric can be applied to a dryer sheet.

DETAILED DESCRIPTION OF THE EMBODIMENTS

The feature of the present disclosure is that in a long-fiber nonwoven fabric produced using two types of polyester materials having different melting points, the fiber density and spatial structure of the nonwoven fabric is adjusted by controlling the spinning conditions of the long fibers and the thickness of the nonwoven fabric. Consequently, a method for producing a nonwoven fabric for a dryer sheet having excellent impregnation property of a fabric softener by increasing a specific surface area and reducing an evenness deviation in the nonwoven fabric can be provided.

The method for producing a nonwoven fabric of the present disclosure starts from the steps of first bicomponent-spinning (or blend-spinning) 70 to 90% by weight of a first polyester filament having a melting point of 250° C. or higher and 10 to 30% by weight of a second polyester filament having a melting point of 235° C. or lower to produce mixed filament yarns so that the fineness of the first filament and the second filament is 3 to 10 denier.

When the content of the first filament in the nonwoven fabric of the present disclosure is less than 70% by weight, the weight fraction of the filament serving as a matrix decreases, so the mechanical properties decrease, and as a result, shape stability at high temperatures and strength, etc. are deteriorated. On the other hand, as the weight fraction of the second filament serving as a binder increases, the aggregation phenomenon between filaments increases, and thus, the evenness deviation may increase.

When the content of the first filament in the nonwoven fabric of the present disclosure exceeds 90% by weight, the binding force between the filaments decreases as the weight fraction of the second filament serving as a binder decreases. Thus, it is difficult to uniformly adjust the thickness in the calendering process.

When the fineness of the first filament is less than 3 denier, yarn breakages are frequently generated, the spinning workability is reduced, and the diameter of the filament is thin, thus making it difficult to increase the porosity in the nonwoven fabric. When the fineness exceeds 10 denier, filament aggregation occurs due to insufficient cooling at the time of bicomponent-spinning, making it difficult to stably conduct the operation. In addition, since the number of filaments per unit area in the nonwoven fabric is small, it is difficult to increase the specific surface area, and the evenness deviation of the nonwoven fabric may increase.

When the fineness of the second filament is less than 3 denier, yarn breakages are frequently generated by the cooling air flow in the direction perpendicular to the drawing direction of the filament, and the spinning workability is deteriorated. When the fineness of the second filament exceeds 10 denier, aggregation phenomenon of the filaments occurs due to insufficient cooling, and defects on the surface of the nonwoven fabric are increased, which may cause a reduction in the evenness deviation of the nonwoven fabric.

By making the first filament and the second filament have the identical or similar fineness, it is possible to reduce the deviation in the size of pores in the nonwoven fabric and thus make the nonwoven fabric have a uniform porosity.

In the step of producing the mixed filament yarns, while spinning and mixing the first filament and the second filament, the filaments can be drawn at a drawing speed of 4,500 to 5,500 m/min using a high-pressure air drawing device to produce mixed filament yarns.

At this time, when the drawing speed is less than 4,500 m/min, the degree of crystallinity of the filaments is low, and the strength and tenacity of the nonwoven fabric are lowered, and when the drawing speed exceeds 5,500 m/min, the filaments are slipped by a drawing air, which may cause entanglement with adjacent filaments and may degrade the evenness of the nonwoven fabric.

Subsequently, a step of forming a web by laminating the mixed filament yarns is performed.

At this time, the web is formed by laminating the mixed filament yarns on a continuously moving conveyor net by a conventional method.

Subsequently, a step of adjusting the thickness in the calendering process of passing the web through a calendering roller to produce a nonwoven fabric having an evenness deviation of 260 or less while having a porosity of 83% or more is performed.

At this time, a calendering process of passing a web by a conventional manner between calender rolls which are heated to 140 to 160° C. and have a gap and treating the web with hot air is performed to impart the smoothness and appropriate thickness in the nonwoven fabric and thus adjust the structure of the nonwoven fabric.

By the second filament, thermal bonding is performed between filaments forming the nonwoven fabric in the calendering process.

At this time, for selective melting of the second filament, the process temperature of the calendering step may be set to be lower than the melting temperature of the second filament as described above. In this case, the heat conduction of the calender rolls cause the bonding between the filaments forming the surface and the inside of the nonwoven fabric, thereby suppressing fuzz-generation when the nonwoven fabric is used as a dryer sheet.

At this time, when the melting point of the second filament exceeds 235° C., it is necessary to increase the surface temperature of the calender rolls for thermal bonding. Consequently, a local thermal shrinkage of the first filament is caused and thus, an evenness deviation may be largely generated.

When the content ratio of the second filament is less than 10% by weight, due to the lack of bonding force between the filaments, the dryer sheet may tumble inside a dryer, causing fuzz and delamination. This may cause damage or contamination of laundry.

When the content ratio of the second filament exceeds 30% by weight, the filaments may aggregate due to insufficient cooling of the filaments during bicomponent-spinning. Consequently, the deviation in weight and evenness in the nonwoven fabric are greatly generated, so that the impregnation amount of a fabric softener decreases or becomes uneven.

The porosity of the nonwoven fabric is a factor that directly affects the impregnation rate of fabric softeners. In order to contain a fabric softener in an amount larger than the weight of the nonwoven fabric for use as a dryer sheet, the porosity of the nonwoven fabric is preferably 83% or more.

The evenness deviation is affected by the filaments that make up the nonwoven fabric and their arrangement. In order to spin the filaments and seat them on the conveyor belt, the opening and seating properties of the fiber filament are improved by controlling the air flow rate applied and the air flow rate sucked during the drawing process, so that and the deviation value of light transmission of 260 or less is achieved.

Consequently, the distribution of pores on the surface of the nonwoven fabric becomes uniform, thereby reducing the difference in the absorption speed for each position of the nonwoven fabric that moves at a constant speed in the impregnation process, to make the impregnation amount of the fabric softener uniform.

In addition, the dead space is reduced, so that the impregnation amount does not decrease in all parts of the nonwoven fabric.

Since the specific surface area is increased by lowering the fineness of the fibers constituting the nonwoven fabric, the impregnated fabric softener increases the area in contact with the fibers constituting the nonwoven fabric, and thus the impregnation rate of the fabric softener can be increased.

In the present disclosure, a nonwoven fabric having a specific surface area of 0.090 to 0.180 $m^2/g$ is preferable because it can increase the impregnation rate of the fabric softener.

When the specific surface area is less than 0.090 $m^2/g$, the impregnation rate of the fabric softener decreases, and when it exceeds 0.180 $m^2/g$, the impregnation rate of the fabric softener may decrease as the porosity decreases.

For the nonwoven fabric produced by the method as described above, a bulky nonwoven structure is formed by adjusting the spinning conditions of the constituent filaments and the thickness of the nonwoven fabric web, the porosity increases while increasing the specific surface area. Therefore, when applied to a dryer sheet, it is possible to have cost competitiveness due to weight reduction, while having excellent impregnation property of a fabric softener.

Hereinafter, the present disclosure will be described in more detail by way of the examples and comparative examples. However, the following examples are for illustrative purposes only, and the present disclosure is not limited by the examples. It will be apparent to those skilled in the art that substitution or modification can be made to equivalent other examples within a range not departing from the technical spirit of the present disclosure.

EXAMPLE 1

Polyethylene terephthalate (PET) having a melting point of 255° C. as a first filament, and copolymerized polyester (CoPET) having a melting point of 210° C. as a second filament were melted at a spinning temperature of 285° C. using a continuous extruder, and then discharged through capillary nozzles in the spinneret. Then, the melted filaments were solidified with a cooling air to form continuous filaments, which were then drawn at a spinning speed of 5,000 m/min using a high-pressure air drawing device to obtain mixed filament yarns.

At this time, the first filament and the second filament were bicomponent-spun so that the content ratio was 90:10 wt %, and the discharge amount and the number of capillary nozzles in the spinneret were adjusted so that the fineness of the first filament became 3 denier and the fineness of the second filament became 5 denier.

Next, the mixed filament yarns were laminated in a web form on the conveyor net at a weight of 20 g/m$^2$, and then subjected to a hot air bonding process of passing between calender rolls at a temperature of 150° C. by a conventional method and treating with hot air at a temperature of 210° C., to produce a spunbonded nonwoven fabric.

At this time, the specific surface area of the nonwoven fabric was allowed to increase, but the thickness was controlled so that the evenness deviation was 260 or less, thereby obtaining a nonwoven fabric having an average thickness of 0.15 (±0.05) mm.

In addition, in order to control the evenness deviation, it was set to the drawing air flow rate (Q1):intake air flow rate (Q2)=1.0:1.0.

EXAMPLE 2

In Example 1, the discharge amount and the number of capillary nozzles in the spinneret were adjusted so that the fineness of the first filament became 5 denier, and the specific surface area of the nonwoven fabric was allowed to increase, but the thickness was controlled so that the evenness deviation became 260 or less, thereby obtaining a nonwoven fabric having an average thickness of 0.17 mm.

EXAMPLE 3

In Example 1, the discharge amount and the number of capillary nozzles in the spinneret were adjusted so that the fineness of the first filament became 10 denier, and the specific surface area of the nonwoven fabric was increased, but the thickness was controlled so that the evenness deviation became 260 or less, thereby obtaining a nonwoven fabric having an average thickness of 0.20 mm.

COMPARATIVE EXAMPLE 1

When preparing the mixed filament yarns in Example 1, it was set to the drawing air flow rate (Q1):intake air flow rate (Q2)=1.0:1.2, and when producing the nonwoven fabric, the specific surface area and the evenness deviation of the nonwoven fabric were not adjusted, thereby obtaining a nonwoven fabric having an average thickness of 0.08 mm.

COMPARATIVE EXAMPLE 2

When producing the mixed filament yarns in Example 1, it was set so that the spinning speed became 6,000 m/min using the drawing device, and the drawing air flow rate (Q1):the intake air flow rate (Q2)=1.0:0.8, thereby obtaining a nonwoven fabric having an average thickness of 0.15 mm.

COMPARATIVE EXAMPLE 3

When producing the mixed filament yarns in Example 3, it was set to the drawing air flow rate (Q1):intake air flow rate (Q2)=1.0:1.2, thereby obtaining a nonwoven fabric having an average thickness of 0.13 mm.

The properties of the nonwoven fabrics of Examples and Comparative Examples were measured using the following test methods, and the results are shown in Table 1 below.

<Test Method>

1. Filament Fineness (denier)

The fineness of the filament was measured according to ASTM D1577.

The fineness of the filament was measured using VIBROSKOP measuring device from Lenzing, and the 10-time measured results were averaged and shown.

2. Thickness of Nonwoven Fabric (mm)

The thickness of the nonwoven fabric was measured according to ASTM D1777.

The result of measuring 10 times/m in the width direction using a Mitutoyo Co., Ltd thickness gauge were averaged and shown.

3. Porosity (%) and Specific Surface Area (m$^2$/g) of Nonwoven Fabric

Measured according to ASTM F316.

A fluid having a viscosity of 0.019 cP was passed through a specimen having a diameter of 2 cm fixed to a measuring part in ESA measuring device from Porous Materials Inc. At this time, the porosity and specific surface area of the specimen were measured by the flow rate according to the pressure.

4. Evenness Deviation of Nonwoven Fabric

Measured using Formation Tester (FMT-MIII) produced by Nomura Shoji Co., Ltd.

The Formation Tester was divided into top end/middle part/bottom end, wherein the top end was a measuring part, the middle part is a transmitting part, and the bottom end was an irradiating part.

A specimen having a size of 25×18 cm (width×length) was fixed to the transmitting part of the Formation Tester, and the fixed specimen was irradiated with light, and then the transmitted light was measured, thereby determining the light transmittance, optical density, and evenness.

The evenness is a quantitative numerical value that converts light transmittance (T, %) into optical density (E=2−logT), and expresses the standard deviation (SD) in the optical density as the value of the coefficient of variation (SD/E*100) for optical density.

5. Impregnation Rate (%) of Fabric Softener

Measured according to ASTM D461.

Measurement was performed by immersing a specimen with a size of 20×20 cm (width×length) in a water bath containing a fabric softener, and standardizing the difference in weight before and after immersion to the weight of the nonwoven fabric.

TABLE 1

| Category | Fineness of first filament (De) | Thickness of nonwoven fabric (mm) | Porosity of nonwoven fabric (%) | Specific surface area ($m^2/g$) | Evenness deviation of nonwoven fabric | Impregnation rate of fabric softener (%) |
|---|---|---|---|---|---|---|
| Example 1 | 3 | 0.15 | 84.25 | 0.171 | 210 | 302 |
| Example 2 | 5 | 0.17 | 86.06 | 0.128 | 224 | 265 |
| Example 3 | 10 | 0.20 | 88.19 | 0.093 | 249 | 109 |
| Comparative Example 1 | 3 | 0.08 | 70.01 | 0.165 | 285 | 82 |
| Comparative Example 2 | 3 | 0.15 | 82.16 | 0.137 | 392 | 97 |
| Comparative Example 3 | 10 | 0.13 | 79.83 | 0.091 | 298 | 76 |

From the results of Table 1, it was confirmed that by adjusting the fineness of the first filament and thickness in the non-woven fabric, as the specific surface area increases, the deviation in density decreases and the evenness deviation reduces, the impregnation rate of a fabric softener increases. On the other hand, it can be seen that when the thickness of the nonwoven fabric is lowered, the improvement of the specific surface area and porosity is deteriorated (Comparative Examples 1 and 3), and the nonwoven fabric composed of the first filament produced by increasing the drawing speed has a reduced specific surface area even at the same thickness (refer to the results of Example 1 and Comparative Example 2), and the impregnation rate of the fabric softener is also lowered.

INDUSTRIAL APPLICABILITY

The present disclosure improves the impregnation properties of a fabric softener in the nonwoven fabric.

The technique according to the present disclosure can be applied to a dryer sheet which is a sheet-type fabric softener.

The dryer sheet according to the present disclosure can contain a high content of a fabric softener and thus increase the flexibility of the washed fabrics, or even in a thinner dryer sheet, a fabric softener is contained in a sufficient amount and thus, cost reduction can be achieved.

The invention claimed is:

1. A nonwoven fabric with improved impregnation property of a fabric softener characterized in that it is a long fiber mixed nonwoven fabric comprising 70 to 90% by weight of a first polyester filament having a melting point of 250° C. or higher and 10 to 30% by weight of a second polyester filament having a melting point of 235° C. or lower, wherein the first filament and the second filament has a fineness of 3 to 10 denier, and the nonwoven fabric has a specific surface area of 0.090 to 0.180 $m^2/g$, and an evenness deviation of 260 or less.

2. The nonwoven fabric with improved impregnation property of a fabric softener according to claim 1, wherein a porosity of the nonwoven fabric is 83% or more.

3. The nonwoven fabric with improved impregnation property of a fabric softener according to claim 1, wherein an impregnation rate of the fabric softener in the nonwoven fabric is 100 to 350%.

4. A method for producing a nonwoven fabric having improved impregnation property of a fabric softener, the method comprising the steps of:

bicomponent-spinning 70 to 90% by weight of a first polyester filament having a melting point of 250° C. or higher and 10 to 30% by weight of a second polyester filament having a melting point of 235° C. or lower, and drawing the spun filaments at a drawing speed of 4,500 to 5,500 m/min to produce mixed filament yarns so that the fineness of the first filament and the second filament is 3 to 10 denier;

laminating the mixed filament yarns to form a web; and adjusting the thickness in the calendering process of passing the web through a calender roller to produce a nonwoven fabric having a specific surface area of 0.090 to 0.180 $m^2/g$ and an evenness deviation of 260 or less.

5. The method for producing a nonwoven fabric having improved impregnation property of a fabric softener according to claim 4, wherein in the step of producing the nonwoven fabric, a porosity is 83% or more.

* * * * *